US008182171B2

(12) United States Patent
Poulsen

(10) Patent No.: US 8,182,171 B2
(45) Date of Patent: May 22, 2012

(54) METHOD FOR RENOVATION OF SURFACE DRESSINGS AROUND WELL CURBS, AND A COMPRESSIBLE DEVICE FOR USE IN THE METHOD

(76) Inventor: Bjarne Henning Poulsen, Mørkøv (DK)

( * ) Notice: Subject to any disclaimer, the term of this patent is extended or adjusted under 35 U.S.C. 154(b) by 147 days.

(21) Appl. No.: 12/569,444

(22) Filed: Sep. 29, 2009

(65) Prior Publication Data

US 2011/0076099 A1 Mar. 31, 2011

(51) Int. Cl.
*E02D 29/14* (2006.01)

(52) U.S. Cl. ..... 404/26; 404/75

(58) Field of Classification Search ..... 404/25, 404/75, 26; 52/20; 137/343, 363
See application file for complete search history.

(56) References Cited

U.S. PATENT DOCUMENTS

| | | | | | |
|---|---|---|---|---|---|
| 3,294,000 | A | * | 12/1966 | Pelsue | 404/26 |
| 4,029,425 | A | | 6/1977 | Pelsue | 404/25 |
| 4,050,839 | A | * | 9/1977 | Vollmar | 404/72 |
| 4,925,336 | A | * | 5/1990 | Simmonds | 404/25 |
| 5,030,030 | A | * | 7/1991 | Simmonds | 404/25 |
| 5,299,884 | A | | 4/1994 | Westhoff et al. | 404/25 |
| 7,153,057 | B1 | * | 12/2006 | Lucas | 404/25 |
| 7,797,892 | B2 | * | 9/2010 | Cannistraro et al. | 52/220.1 |
| 2002/0150424 | A1 | | 10/2002 | Brodeur | 404/26 |
| 2010/0178106 | A1 | * | 7/2010 | Mitchell | 404/26 |

FOREIGN PATENT DOCUMENTS

| | | | |
|---|---|---|---|
| DE | 196 09 776 | A1 | 9/1997 |
| DE | 201 19 377 | | 3/2002 |
| DE | 103 29 695 | | 2/2005 |
| EP | 0 300 829 | A1 | 1/1989 |
| GB | 2 155 086 | A | 9/1985 |
| JP | 08-284243 | A | 10/1996 |
| WO | WO 99/29968 | A1 | 6/1999 |

OTHER PUBLICATIONS

European Search Report dated Sep. 8, 2009 for application No. EP 09161425 filed May 28, 2009.

* cited by examiner

*Primary Examiner* — Gary S Hartmann
(74) *Attorney, Agent, or Firm* — Winston & Strawn LLP

(57) ABSTRACT

A method for renovating a well curb by lifting it to a first position, whereafter a compressible device is positioned around the well curb. Hereafter the well curb is lowered to a second position so that the compressible device is abutting the upper edge of the well, whereafter a casting material is injected into the cavity between the surface dressing and a filling around the well. Finally the well curb is lowered to a third and final position. Also, a compressible device for use in the method.

10 Claims, 5 Drawing Sheets

METHOD FOR RENOVATION OF SURFACE DRESSINGS AROUND WELL CURBS, AND A COMPRESSIBLE DEVICE FOR USE IN THE METHOD

TECHNICAL FIELD

The present invention relates to a method for renovation of surface dressings around well curbs, and a compressible device for use in the method according to the present invention.

Ordinary wells or shafts, e.g. wells that are a part of a sewerage system, surmounts upwards with a curb and a cover. Within the scope of the present invention the term "well curb" is to be understood as a curb, which is a part of a covering of a well, shaft or the like.

A well-known way of fitting is to place the lower edge of the well curb on the top edge of the well or shaft, in such a way that the well is carrying the majority or all of the weight of the curb and cover. The surface dressing, e.g., ordinary road surfaces such as asphalt, is in this case not directly connected to the well curb. It is a well-known phenomenon that surface dressings, especially road surfaces such as asphalt or bituminous surfaces, settle over time. This is in particular the case for the area between the curb and the road surface where weather exposure as temperature based expansions and contractions has a far greater effect than with the continuous road surface. It is thus a drawback of the above method that the road, which is not connected to the curb, will settle and thus the curb will extend over road level.

In some cases the well curb is positioned with a clearance in the related well or shaft. These well curbs will in the following be referred to as floating well curbs. Well curbs of the floating kind avoid the above problem in that these are connected to or are resting on the actual road surface. On the other hand such a floating curb is not connected to the well. The main part or the entire weight of the curb is thus carried by the road or road surface. This means that the curb will sink or level together with the road surface. Despite the advantage of floating, it is still necessary to renovate the road surface around the well curb regularly as the asphalt around the well curb still will settle.

The area around the well curb is typically renovated by lifting the well curb, whereafter all material, which has settled around the opening in the road surface, e.g., asphalt, is removed. Hereafter an installation frame is positioned where the well curb will be lying afterwards. The excavated area is filled with new asphalt and then the installation frame is removed and the well curb is positioned. The well curb might be rolled into the covering layer. The disadvantage of this method is that it is time consuming and costly. Furthermore, the problems with settling will return and thus it will be necessary to perform this type of renovation regularly.

Accordingly, the prior art treatments for renovating well curbs have deficiencies which the present invention is designed to resolve.

SUMMARY OF THE INVENTION

It is thus a first aspect of the present invention to provide a method for renovation of surface dressings around well curbs whereby it is possible faster and easier to renovate surface dressings around the well curbs.

In a second aspect according to the present invention a method for renovation of surface dressings around well curbs is provided whereby it is possible to significantly lower expenses related to the renovation of such surface dressings.

In a third aspect a compressible device is provided which facilitates the operation and conducting of such renovation methods.

The new and unique features whereby these aspects are achieved according to the present invention reside in a method for renovation of surface dressings around well curbs, where the method comprises a lifting of the well curb to a first position, placement of a compressible device around the well curb, lowering of the well curb to a second position so that the compressible device is abutting an upper edge of a well, injection of a casting material into the cavity between the surface dressing and a filling around the well, and lowering of the well curb to a final third position.

The method is preferably used for renovation of surface dressings around floating well curbs. To ensure that no material spills into the well a collector may be mounted in the upper part of the well before the method according to the present invention is initiated.

The existing curb is raised to a first position, e.g., by use of a suited lifting device, which secures that the surface dressing around the curb is not damaged or looses stability. The curb may then, if necessary, be cleaned of remains of surface dressing or rust. Similarly, the existing surface dressing can be cleaned of loose flakes or other removable material. This can for example be done by use of a pneumatic chisel or by compressed air. If the surface dressing is wet it can be dried by an appropriate device, e.g., a gas burner or other heating device.

In the curb's first position, a compressible device is positioned around the curb. The compressible device can be e.g., a ring or a frame of foam rubber. It is important that the shape of the compressible device fits the concerned curb, i.e., if it is a curb with a circular cross section a ring-shaped compressible device is used. If on the other hand it is a curb with a rectangular or square cross section a rectangular or square frame-shaped compressible device is used.

The goal of the compressible device is to ensure a packing between the curb and the upper edge of the well. By means of this packing, casting material is prevented from floating into the well. A further advantage is found in that the compressible device prevents that the curb is cast to the upper edge of the well.

The curb with the positioned compressible device is then lowered to a second position so that the compressible device is abutting the upper edge of the well. This second position can for example be around 20 mm above the surface level, e.g., the road level. In this example the upper edge of the curb will thus project 20 mm above the road level. In this position a casting material is injected into the cavity between the surface dressing and the filling around the well. In a particularly advantageously embodiment, the casting material is liquid, e.g., a liquid asphalt based composition.

The curb is thus lowered to a permanent third position, which is the same as the final port-renovation-position. This further lowering is possible even though the compressible device already is abutting the upper edge of the well, because the device around the well curb is compressible. The curb is kept in this position until the casting material has hardened. Hereafter the lifting device can be dismounted. Excess casting material may be removed and the transition between the surface and the renovated area may if necessary be applied a suitable hardening agent.

An advantage of the method according to the present embodiment is that a full depositing between the surface, e.g. asphalt, and the well curb is ensured. Furthermore, the method results in that the existing surface or roadway is maintained around the well curb, which prevents subsequent settlements of the area. The method according to the present invention is conducted significantly faster than already known renovation methods.

It is to be emphasized that there is made no or very small demands to the long-term durability of the compressible device. As soon as the casting material has hardened the compressible device has fulfilled its function. This means that the intended function is not to carry the curb. In principle the compressible device according to the present invention can thus be made of a biologically degradable material.

According to an embodiment of the method according to the present invention, the compressible device is a ring or a frame made of a material comprising at least one natural or synthetic polymer. Considered polymers comprise rubber, foam rubber, butyl rubber, silicone rubber, polybutadiene, polyisobutylene, polyurethane and polyurethane foam.

According to another embodiment of the method according to the present invention the compressible device is inflatable. This can be implemented by means of a ring or a tube, which can be inflated by compressed air or by a fluid.

According to yet another embodiment of the method according to the present invention the casting material comprises an asphalt based composition, e.g., the asphalt for repairing "Vergumix Super Mak" from the company Vergutech Scandinavien, Digemosevej 1, DK-4340 Tølløse, Denmark.

According to yet another embodiment of the method according to the present invention, the lifting and lowering of the well curb is done by means of a lifting apparatus, e.g., the hydraulic well curb lifting device "MSRH-50" from the company Hans Joch Machinenbau GmbH, Reiffeisenstrasse 63, D-74906 Bad Rappenau, Germany.

The present invention further comprises a compressible device for positioning around a well curb by the method according to the present invention. In a preferred embodiment this device is a ring or a frame made of a material comprising at least one natural or synthetic polymer. The compressible device may be inflatable or made of at least one biologically degradable material.

Another embodiment of the invention relates to the a well curb restoring combination comprising a well curb and compressible device for positioning adjacent and around a well curb, wherein the compressible device has sufficient strength to initially hold the well curb in an initial position above the well and sufficient compressibility to allow lowering of the well to a final position.

BRIEF DESCRIPTION OF THE DRAWINGS

The invention will be described below with reference to the drawings wherein.

DETAILED DESCRIPTION OF THE PREFERRED EMBODIMENTS OF THE INVENTION

In a preferred embodiment, the invention relates to a method for renovation of a surface dressing around a well curb of a well by lifting the well curb to a first position above the well; placing a compressible device adjacent the well curb; lowering the well curb to a second position wherein the compressible device abuts an upper edge of the well; injecting a casting material into the cavity formed between well curb, compressible device and surrounding area to form a surface dressing that fills the cavity around the well; and lowering the well curb to a third and final position by compressing the compressible material.

The invention also provides a well curb restoring combination comprising a well curb and compressible device for positioning adjacent and around a well curb, wherein the compressible device has sufficient strength to initially hold the well curb in an initial position above the well and sufficient compressibility to allow lowering of the well to a final position. The compressible device may be made in the form of a ring or a frame made of a material comprising at least a natural or synthetic polymer which is compressible. The compressible device may instead be inflatable to hold the well curb in the initial position and deflatable to allow lowering of the well curb to its final position. To be environmentally friendly, the compressible device can be made of at least one biologically degradable material.

Figure 1:
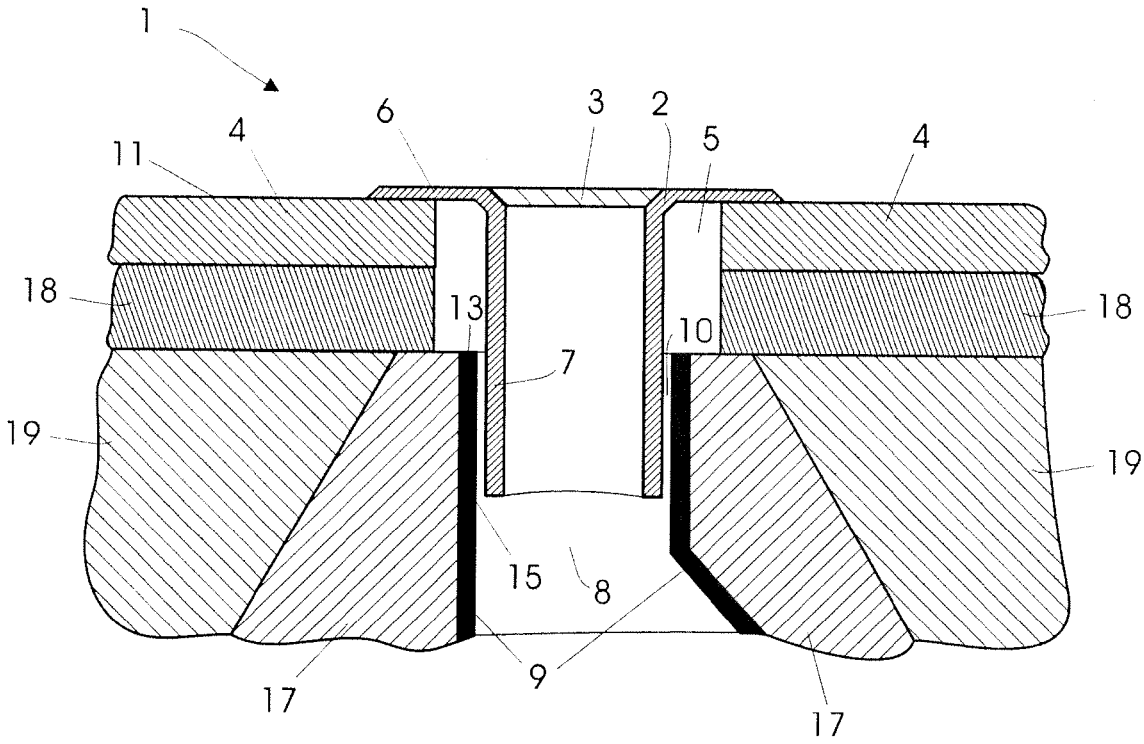
FIG. 1 shows a cross section of an area around a well curb of the floating kind.

The area 1 around a well curb 2 of the floating kind, as shown in FIG. 1, comprises a well curb 2 with a matching cover 3. Furthermore a surface dressing 4 is shown, e.g., a road layer such as asphalt, which defines a surface level 11. In the surface dressing 4 is an opening 5, which e.g. is shaped as a circular opening. The well curb 2 has a flange 6 resting on the surface dressing 4. The well curb 2 has a lower part 7, which for example, can be shaped as a cylindrical casing, and which is introduced through opening 5 into an opening 8 of a well 9. The opening 8 can e.g., 10 have a circular cross section. Around the well 9 is formed a filling 17. The filling 17 is surrounded by soil 19. Below the surface dressing 4 is a base 18. Between the outer side of the lower part 7 of the well curb 2 and the inner side 15 of the well opening 8 is a air gap 10 which cause the well curb 2 to hang or "float" freely. The air gap 10 can e.g. be ring shaped.

Figure 2:
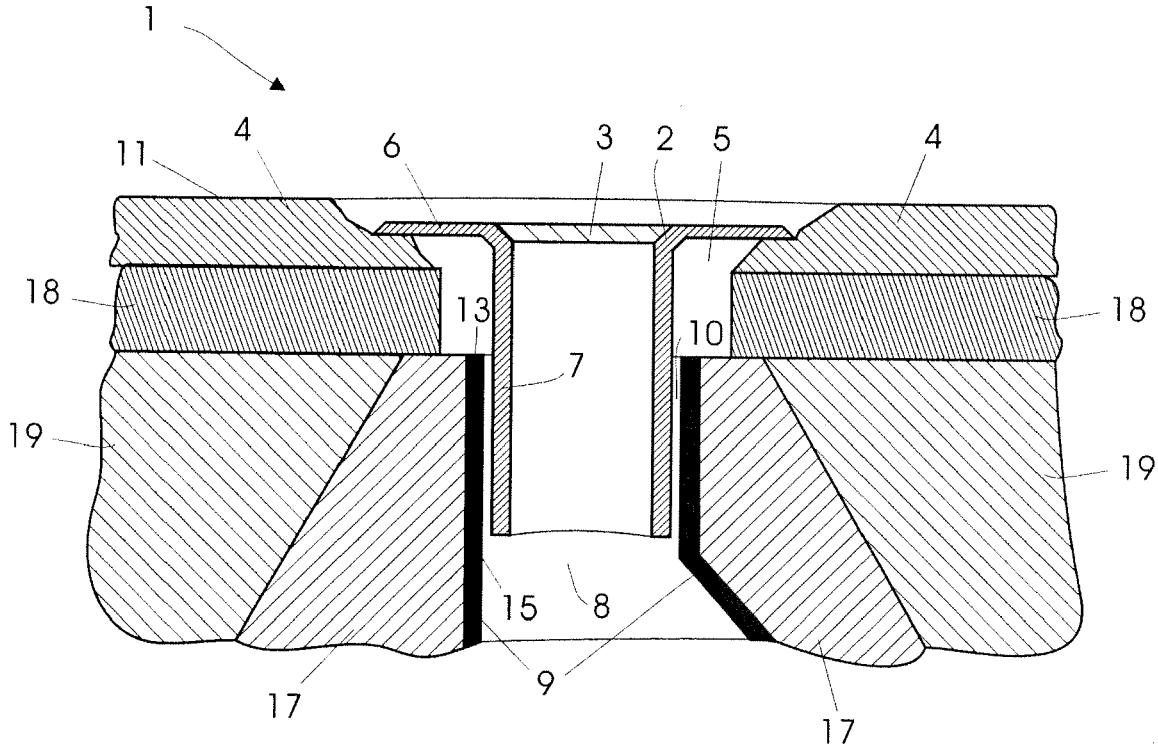
FIG. 2 shows a cross section through an area around a floating well curb where the area needs renovation.

FIG. 2 shows a situation where the upper edge of the well curb has sunk below the original surface level 11 of the surface dressing 4. This is due to settling and/or erosion of the surface dressing 4. It is these surface dressings 4 in such a condition that need renovation by means of the method and devices of the present invention.

Figure 3:
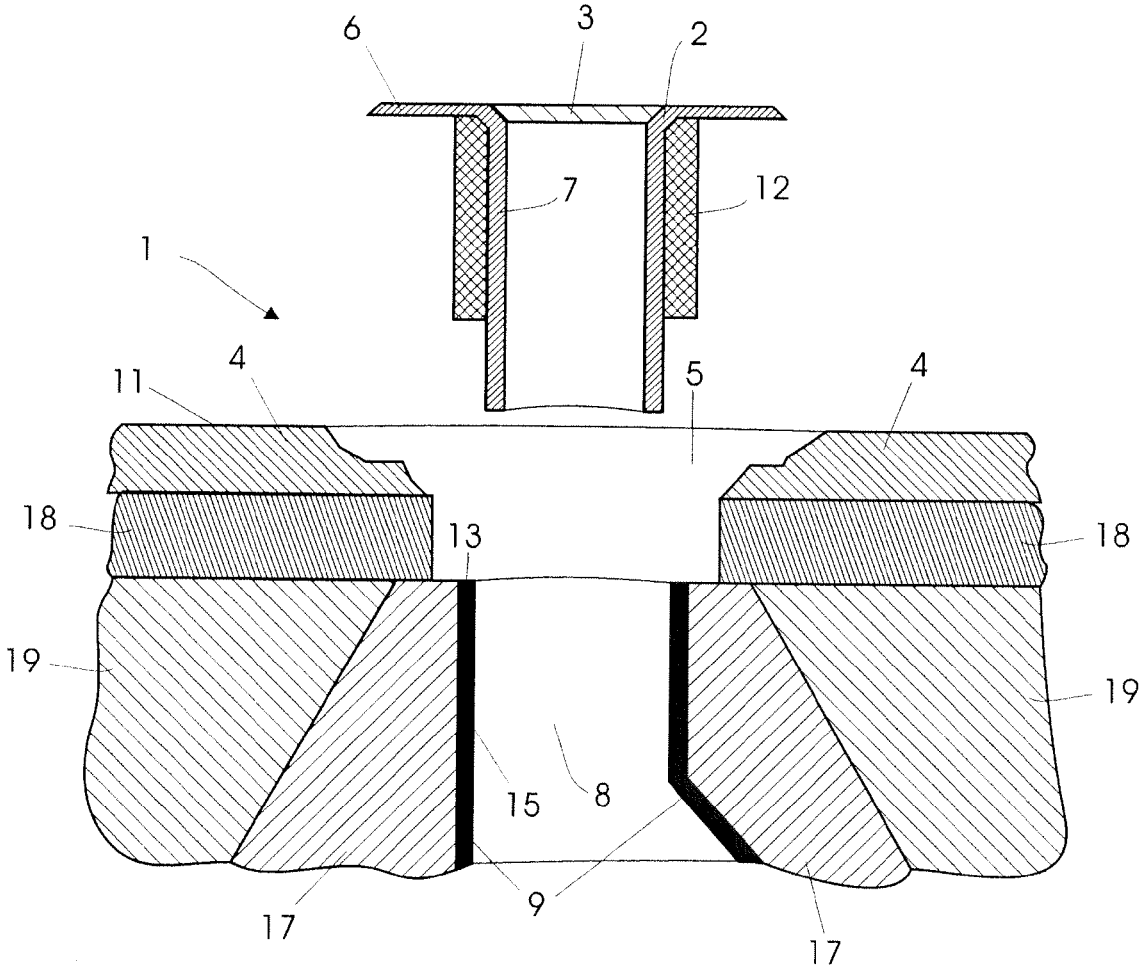
FIG. 3 shows a cross section through an area around a floating well curb where the area needs renovation and where the well curb has been elevated to the first position.
Figure 4:
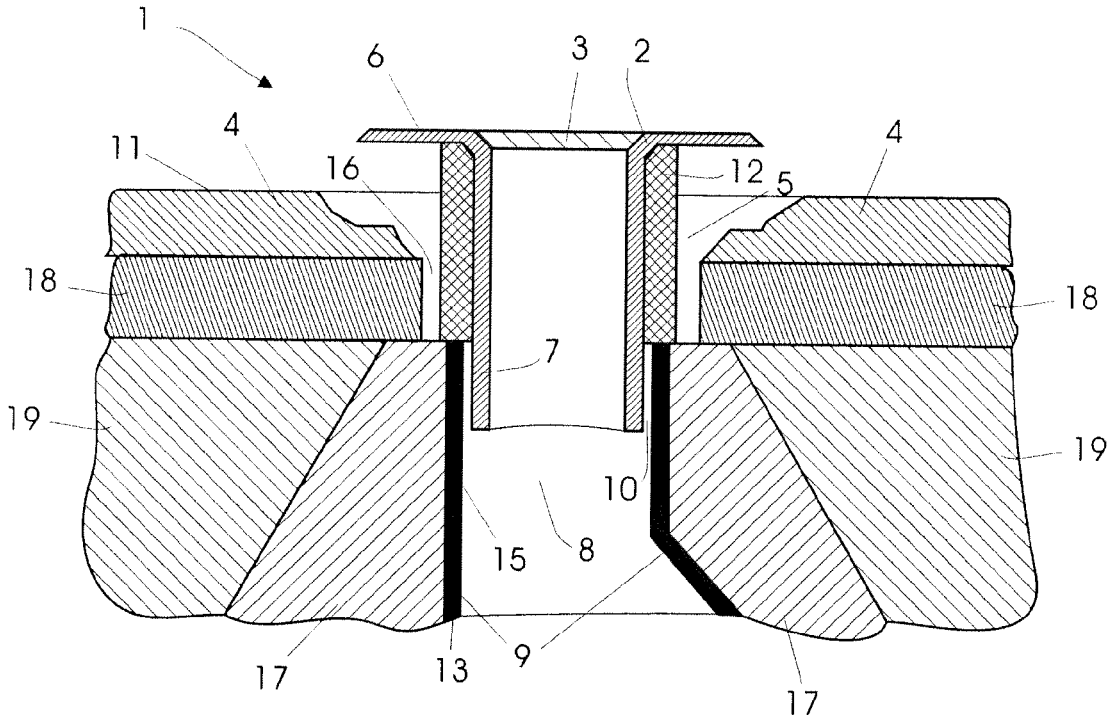
FIG. 4 shows a cross section through an area around a floating well curb where the area needs renovation and where the well curb has been lowered to the second position.

FIG. 3, shows the same area as in FIG. 2. The difference is that the well curb 2 in FIG. 3 has been lifted up to a first position which allows the placement of a compressible device 12 around the well curb 2's lower part 7. The lifting can for example be carried out by means of a suitable machine (not shown). The compressible device 12 can e.g. be a rubber foam ring. The compressible device 12 can e.g. be shaped and positioned in such a way that it is abutting the upper edge 13 of the well 9 when the well curb 2 is lowered to the second position, as shown in FIG. 4. The lowering is e.g. carried out by a suitable machine.

Figure 5:
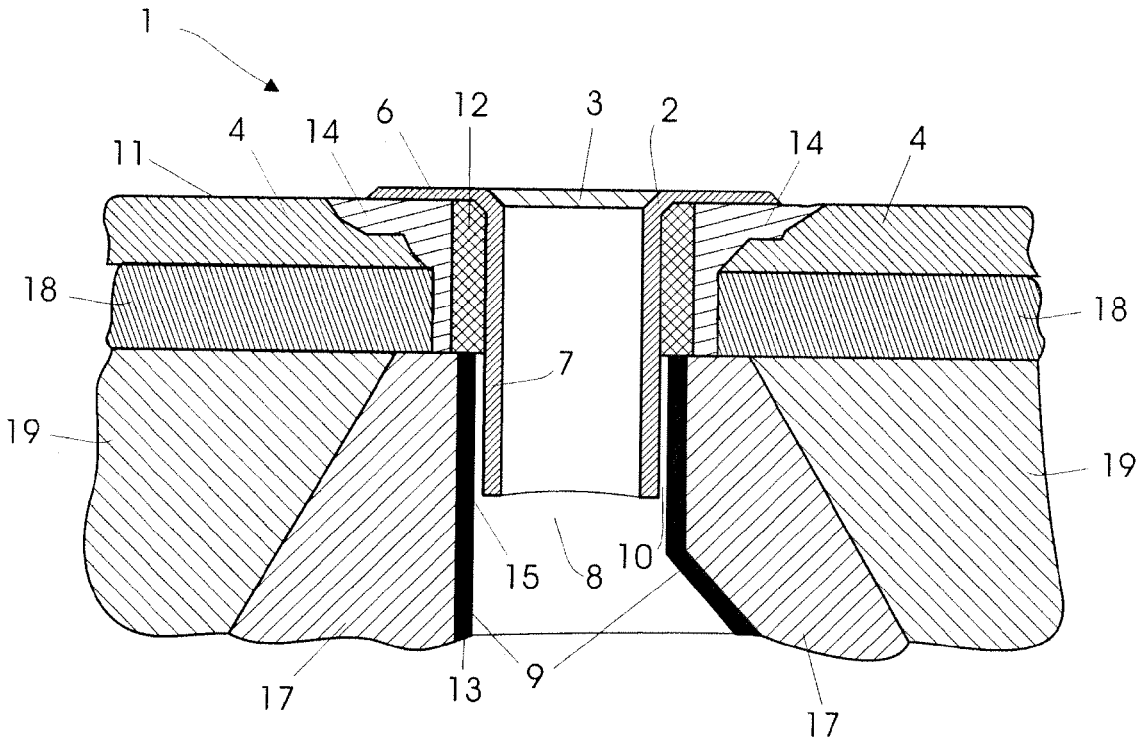
FIG. 5 shows a cross section through an area around a floating well curb where the area has been renovated and the well curb has been lowered to the final third position.

In FIG. 4 the compressible device 12 is as mentioned abutting the upper edge 13 of the well curb 2 (as is shown in FIGS. 1-3) which permits injection of a casting material 14 (as shown in FIG. 5) into the cavity 16 between the surface 5 dressing 4 and the filling 17 around the well 9, without the casting material 14 spilling into the air gap 10 between the outer side of the lower part 7 of the well curb and the inner side 15 of the well opening 8. At the same time the vertical level of the well curb 2 is a little above both its final level and the surface level 11. This makes it easier to inject the casting material 14. The thickness of the compressible device 12 is sufficient to cover the border area between the upper edge 13 of the well 9 and the surrounding filling 17. Hereby it is avoided that the well curb 2 is cast to the upper edge 15 of the well 9.

The final step in the method according to the present invention is shown in FIG. 5. The well curb 2 is lowered to its final position, which equals the original position shown in FIG. 1. The well curb is still carried by e.g. a machine (not shown) until the casting material 14 has hardened. If the casting material 14 is a fluid material, as e.g., two component asphalt emulsion, it also implies that the lowering of the well curb 2 from its second position to its third final position must happen before the fluid material has hardened. When the well curb 2 is transferred from its second position to its third position the compressible device 12 is been compressed in its vertical direction, i.e. upset.

The area and the method as shown in the FIGS. 1-5 are to be regarded as examples and are not to be construed as limiting the scope of the invention to the shown embodiments or areas. Even if the flange 6 of the well curb 2 in FIG. 5 is resting on the casting material 14 it could in principle also be that the flange 6 of the well curb 2 is settled or rolled into the casting material 14 so that the upper edge of the well curb 2 is at the same level as the surface level 11. Similarly it is of course possible that the renovation area comprises more layers than shown in FIGS. 1-5, such as a base or a wearing course.

What is claimed is:

1. A method for renovation of a surface dressing around a well curb of a well, the well curb having a flange proximate a surface dressing, the method comprising:

lifting the well curb to a first position above the well;

positioning a compressible device around the well curb, wherein the compressible device has a size that is smaller than a flange periphery;

lowering the well curb to a second position wherein the compressible device abuts an upper edge of the well and forms a cavity between the well curb, the compressible device and a surrounding area;

injecting a casting material into the cavity to form the surface dressing that fills the cavity around the well; and lowering the well curb to a third and final position by compressing the compressible device.

2. The method of claim 1, wherein the compressible device comprises a ring or a frame which is made of a material comprising at least one natural or synthetic polymer which is compressible.

3. The method of claim 1, wherein the compressible device is inflatable and is inflated to be positioned adjacent the well curb and deflated to lower the well curb to its final position.

4. The method of claim 1, wherein the casting material comprises an asphalt-based composition.

5. The method of claim 1, wherein the lifting and lowering of the well curb is done by means of a lifting apparatus.

6. The method of claim 1, wherein the well curb is a floating well curb and the compressible device is made of at least one biologically degradable material.

7. The method of claim 1, wherein the compressible device has a thickness that covers a border area between the upper edge of the well and the surrounding filling sufficient to avoid casting of the well curb to the upper edge of the well.

8. The method of claim 1, wherein the well curb is a floating well curb.

9. The method of claim 1, wherein the well curb has an inner diameter that is smaller than the outer diameter of the well.

10. A method for renovation of a surface dressing around a well curb of a well which comprises:

lifting the well curb to a first position above the well;

placing a compressible device adjacent the well curb;

lowering the well curb to a second position wherein the compressible device abuts an upper edge of the well;

injecting a casting material into a cavity formed by the well curb, the compressible device and a surrounding area to form a surface dressing that fills the cavity around the well; and lowering the well curb to a third and final position by compressing the compressible device, wherein the compressible device is formed independently of the surface dressing.

* * * * *